US010086856B2

(12) United States Patent
Wernicke

(10) Patent No.: US 10,086,856 B2
(45) Date of Patent: Oct. 2, 2018

(54) CONTROL OF RAIL VEHICLES

(71) Applicant: SIEMENS AKTIENGESELLSCHAFT, Munich (DE)

(72) Inventor: Manfred Wernicke, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 642 days.

(21) Appl. No.: 14/429,634

(22) PCT Filed: Sep. 5, 2013

(86) PCT No.: PCT/EP2013/068340
§ 371 (c)(1),
(2) Date: Mar. 19, 2015

(87) PCT Pub. No.: WO2014/044541
PCT Pub. Date: Mar. 27, 2014

(65) Prior Publication Data

US 2015/0274185 A1 Oct. 1, 2015

(30) Foreign Application Priority Data

Sep. 19, 2012 (DE) ..... 10 2012 216 744

(51) Int. Cl.
*B61L 23/22* (2006.01)
*B61L 23/30* (2006.01)
(Continued)

(52) U.S. Cl.
CPC ..... *B61L 23/22* (2013.01); *B61L 3/125* (2013.01); *B61L 23/00* (2013.01); *B61L 23/24* (2013.01); *B61L 23/30* (2013.01); *B61L 27/0038* (2013.01)

(58) Field of Classification Search
CPC ..... B61L 23/00; B61L 23/22; B61L 23/24; B61L 23/26; B61L 23/28; B61L 23/30; B61L 23/32; B61L 3/125
See application file for complete search history.

(56) References Cited

U.S. PATENT DOCUMENTS 2,617,014 A * 11/1952 Judge ..... B61L 23/22 246/3
2,703,839 A * 3/1955 Judge ..... B61L 23/22 246/33
(Continued)

FOREIGN PATENT DOCUMENTS

DE 3347180 A1 7/1984
DE 19749697 A1 4/1999
(Continued)

OTHER PUBLICATIONS

Wennrich R. "Der Elektronische Token fuer die Agyptischen Eisenbahnen" Signal + Draht, telzlaff Verlag GmbH, Darmstadt, vol. 89, No. aa pp. 30-34, ISSN; 0037-4997, xp000779911, 1997, DE.
(Continued)

*Primary Examiner* — Zachary L Kuhfuss
(74) *Attorney, Agent, or Firm* — Laurence Greenberg Werner Stemer; Ralph Locher

(57) ABSTRACT

A decentralized control of rail vehicles that run in alternating directions on a single-track route, e.g., between two train stations by way of an exclusive right (token). A storage device is arranged at each end of the route, for instance an RFID unit. Only a single exclusive right exists for the route. The exclusive right is either stored in one of the two storage units or carried along by a rail vehicle that is traveling on the route. In the latter case, an additional rail vehicle is effectively prevented from traveling on the route, because none of the storage units can provide the exclusive right, which is
(Continued)

being transported between the storage units by the rail vehicle and is occupied by the rail vehicle. The novel concept creates an efficient possibility of decentralized train protection and thus can be implemented significantly more economically than existing centralized train safety approaches.

14 Claims, 3 Drawing Sheets

(51) Int. Cl.

| | |
|---|---|
| ***B61L 3/12*** | (2006.01) |
| ***B61L 23/24*** | (2006.01) |
| ***B61L 23/00*** | (2006.01) |
| ***B61L 27/00*** | (2006.01) |

(56) References Cited

U.S. PATENT DOCUMENTS

| | | | | | |
|---|---|---|---|---|---|
| 2,874,272 | A * | 2/1959 | Staples | B61L 23/22 | 246/3 |
| 2,916,612 | A * | 12/1959 | Marple | B61L 7/088 | 246/134 |
| 3,286,091 | A * | 11/1966 | Ferm | B61L 21/06 | 246/134 |
| 4,538,781 | A | 9/1985 | Birkin | | |
| 5,437,422 | A * | 8/1995 | Newman | B61L 27/0038 | 246/182 R |
| 5,947,423 | A * | 9/1999 | Clifton | B61L 3/225 | 246/167 R |
| 7,099,754 | B2 * | 8/2006 | Sugita | B61L 23/14 | 246/14 |
| 2005/0149795 | A1 * | 7/2005 | Manoni | B61L 17/00 | 714/726 |
| 2005/0240322 | A1 * | 10/2005 | Peltz | B60L 9/00 | 701/19 |
| 2008/0068164 | A1 * | 3/2008 | Campbell | B61L 3/125 | 340/572.1 |
| 2012/0004796 | A1 * | 1/2012 | Michaut | B61L 11/08 | 701/19 |
| 2015/0353110 | A1 * | 12/2015 | Kernwein | B61L 25/02 | 701/117 |

FOREIGN PATENT DOCUMENTS

| | | | |
|---|---|---|---|
| EP | 0076672 | A2 | 4/1983 |
| EP | 1075995 | A1 | 2/2001 |
| GB | 286108 | A | 3/1928 |
| GB | 2134295 | A | 12/1983 |
| JP | H026268 | A | 1/1990 |
| WO | 2007036468 | A1 | 4/2007 |

OTHER PUBLICATIONS

Railway Group Standard: Radio Electronic Token Block, Railway Group Standard, URL; http//www.rgsonline.co.uk/railway_Group_Standards/Control Command and Signaling/railway Group Standards/GKRT0054ISS1.pdf; pp. 1-18;XP055106801;1998;GB.

* cited by examiner

CONTROL OF RAIL VEHICLES

BACKGROUND OF THE INVENTION

Field of the Invention

The invention relates to a method for controlling rail vehicles, a corresponding apparatus and a suitably equipped rail vehicle.

For a single-track line section between two stations with alternating traversal directions, it is known that the problem of train protection has to be solved using complex interlocking and signaling technology together with a train control system comprising a train stop function.

The disadvantage of this is that train protection is implemented centrally for the single-track line section, which increases the complexity.

BRIEF SUMMARY OF THE INVENTION

The object of the invention is to avoid this disadvantage and present an alternative decentralized, less complex solution which also ensures train protection having the reliability required for rail services.

This object is achieved according to the features of the independent claims. Preferred embodiments are set forth particularly in the dependent claims.

To achieve the object, a method for controlling rail vehicles is proposed in which

- a line section has a first and a second storage device, wherein no more than one of the storage devices provides an exclusive right of way on the line section,
- the exclusive right of way on the line section is read from the first storage device by a rail vehicle and the first storage device is placed in a state in which it provides no exclusive right of way on the line section,
- the exclusive right of way is passed to the second storage device by the rail vehicle.

Thus, particularly for a single-track line section between two stations with alternating traversal directions, the problem of train protection is solved by means of the exclusive right of way (implemented e.g. using a token). This advantageously involves minimal use of decentralized lineside equipment.

The exclusive right of way can also be advantageously used for controlling the rail vehicle (e.g. initiating or carrying out a braking operation).

A development is that the line section is a single-track line section, e.g. between two stations.

Another development is that the exclusive right of way is passed to the second storage device by the rail vehicle shortly before, shortly after or as it leaves the line section.

Another development is in particular that the storage devices are disposed in the area of the ends of the single-track line section.

A further development is that the first storage device and the second storage device have an RFID tag, wherein the exclusive right of way corresponds to at least one predefined value or signal of the RFID tag.

The RFID tag can therefore be read by the rail vehicle as it enters the line section and marked as invalid by means of a control signal. Alternatively, an invalid value can also be written to the RFID tag by the rail vehicle, wherein basically any value is possible which indicates that no exclusive right of way can be provided by the storage device.

It should be noted here that any type of communication is possible between the rail vehicle and the storage devices, e.g. wireless transmission, near field communication, communication via a (power) line, etc. The storage device can be of active or passive design. The rail vehicle's communication device which is designed to read and/or write the exclusive right of way or information associated with the exclusive right of way can likewise be of active or passive design.

Another development is that, to enter the line section, the exclusive right is read from the first storage device and stored by the rail vehicle.

In this case the exclusive right of way can be "carried away" and possibly stored in the second storage device ("passed") by the rail vehicle as it leaves the line section. Figuratively speaking, the rail vehicle therefore transports the exclusive right of way from the first to the second storage device. There are a plurality of technical implementations that allow this kind of functional "transportation" of the exclusive right of way. For example, approaches can be used which assign and administer a token in order to ensure (temporary) exclusivity of a resource, in this case of the line section.

It should be noted at this juncture that the first and second storage device can of course be interchangeable. In particular, they can essentially be implemented in a functionally symmetrical manner, i.e. both storage devices are designed to provide the exclusive right of way and, having done so, be unable to provide the exclusive right of way again until the exclusive right of way has been designated—e.g. by means of the rail vehicle—as "providable", e.g. reset or stored. However, if these two storage devices are to control exclusive running on a line section, always only one or else neither of the two can provide the exclusive right of way when a rail vehicle enters the section. This ensures train protection in a reciprocal manner for alternating operation on the line section.

As part of an additional development, once the exclusive right of way has been read, the exclusive right of way is marked as invalid, overwritten, reset or deleted in the first storage device.

These are some possibilities for implementing an exclusive right of way in the storage device. For example, a memory area, e.g. a number of bits, a flag, a marker, etc. may be suitable for this purpose.

Basically any mechanism can be provided which ensures that, once the exclusive right of way has been provided, it can no longer be provided by the first storage device. Preferably the exclusive right of way cannot be provided again until it has first been made available again to the first storage device, e.g. is stored therein.

Another development consists in that the rail vehicle has a communication device for reading from and writing to the first and the second storage device.

One embodiment is that the rail vehicle is braked if it has not received the exclusive right of way on entering the line section.

In particular, the rail vehicle can be equipped with a monitoring device which in this case initiates a braking operation, e.g. forced braking. In addition, a warning can be output or triggered.

An alternative embodiment consists in that the exclusive right of way comprises, in particular, a signal, a token, a value, an item of information.

Another embodiment is that the exclusive right of way and/or the operations involving the exclusive right of way are executed with data security.

For example, the exclusive right of way can be signed and/or encrypted. Alternatively or in addition, access to the exclusive right of way can be allowed subject to authorization, i.e. the rail vehicle and/or the driver must first be authorized, for example. In particular, one option is that the exclusive right of way is implemented in a tamper-proof manner.

One embodiment is also that a state of the first storage unit and/or of the second storage unit relating to the availability of the exclusive right of way is displayed.

For example, a light and/or signal device can be provided which already indicates e.g. to a driver in the station whether the exclusive right of way is available and whether the rail vehicle can enter the line section. This is advantageous if the storage unit has already been located e.g. at the start of the actual section: this can prevent the situation whereby the rail vehicle sets off and then has to stop or reverse if the exclusive right of way is not available.

The statements relating to the method apply accordingly to the other claim categories.

The above mentioned object is also achieved by an apparatus for providing an exclusive right of way for controlling rail vehicles, comprising a memory, wherein the apparatus is disposed on, at or in the vicinity of a line section, comprising a communication device for communicating with a rail vehicle, wherein the rail vehicle is provided with the exclusive right of way on the line section by means of the communication device if the exclusive right of way is providable, in particular is present in the memory (e.g. stored or set as providable), wherein in this case the apparatus can be placed in a state in which the exclusive right of way can no longer be provided.

The apparatus can have a memory which is designed at least for temporarily storing the exclusive right of way.

In particular a plurality of, e.g. two, such apparatuses can be disposed along the line section, e.g. at the ends of a line section which may only be traversed if an exclusive right of way is obtained. This apparatus can be the above described storage device or rather said storage device can be incorporated in said apparatus.

One embodiment consists in that the communication device is a near field communication device.

In another embodiment, the rail vehicle is not provided with the exclusive right of way on the line section by means of the communication device if the exclusive right of way is not providable, in particular present in the memory (e.g. not stored or not set as providable).

A development consists in that the communication device is provided with the exclusive right of way by means of the rail vehicle when it exits the line section, e.g. it is thereby transmitted, set or stored in the memory of the apparatus.

The above mentioned object is also achieved by means of a rail vehicle having a communication device for communicating with a first and a second storage device, wherein an exclusive right of way on a line section can be read from the first storage device by means of the communication device, and the first storage device can be placed in a state in which it provides no exclusive right of way on the line section, wherein the exclusive right of way can be passed to the second storage device so that the second storage device is placed in a state in which it provides exclusive right of way on the line section.

In a development, the rail vehicle has a monitoring device by means of which a predetermined action can be carried out, in particular issuing of a warning or initiation of a braking operation, if the line section is entered without exclusive right of way having been obtained.

The solution presented here also includes a computer program product which can be directly loaded into a memory of a digital computer, comprising program code sections which are suitable for executing steps of the method described here.

The abovementioned problem can also be solved by means of a computer-readable storage medium, e.g. any type of memory, incorporating computer-executable instructions (e.g. in the form of program code) which are suitable for computer execution of steps of the method described here.

The storage device, apparatus, communication device and/or monitoring device mentioned here can be implemented in particular as a processor unit and/or an at least partially hardwired or logical circuit arrangement which is designed, for example, such that the method as described herein can be carried out. This can be any kind of processor or PC or computer having the necessary peripherals (memory, input/output interfaces, I/O devices, etc.) or include such.

The above described characteristics, features, and advantages of the invention as well as the way in which they can be achieved will become clearer and more readily understandable in conjunction with the following schematic description of exemplary embodiments which will be explained in greater detail with reference to the accompanying drawings. For clarity, elements that are identical or have an identical effect are provided with the same reference characters.

DESCRIPTION OF THE INVENTION

For safe rail operation, e.g. over a single-track line section which is preferably used by rail vehicles running in different directions, an approach using a decentrally administered exclusive right of way is proposed.

(1) The exclusive right of way (e.g. by means of a "token") for simplified traffic management is provided decentrally by electronic means, e.g. using an RFID tag, between the rail vehicles running in different directions over the single-track line section.

A token is a synchronization aid. The rail vehicle in possession of the token may access the resource, in this case traverse the line section. When the token is released, another rail vehicle may use the line section.

Figure 1:
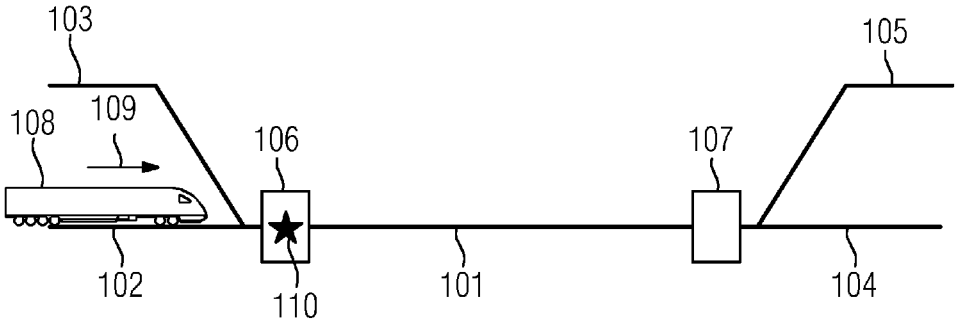
FIG. 1 schematically illustrates a single-track line section connecting two stations, wherein there is disposed at either end of the line section a storage device by means of which exclusive operation on the single-track line section can be ensured.

FIG. 1 is a schematic representation showing a single-track line section 101 connecting two stations, here indicated by way of example by the tracks 102 and 103 on the left-hand side and the tracks 104 and 105 on the right-hand side. A storage device 106 is disposed at one end of the line section 101 and a storage device 107 at the other end of the line section 101. The storage devices 106 and 107 can be RFID units, e.g. in particular RFID tags.

Also shown in FIG. 1 is a rail vehicle 108 which wishes to enter the line section 101 from the track 102 in a direction of travel 109. The rail vehicle has a communication unit for communicating with the storage device 106 and/or 107. This communication unit can be implemented e.g. as an RFID unit which can be used to both read and write an RFID tag of the RFID units 106 and 107.

In the example according to FIG. 1, the storage device 106 incorporates an exclusive right of way 110 in the form of a token. The rail vehicle 108 can only proceed onto the line section 101 if the exclusive right of way 110 is present in the storage device 106. In this case the rail vehicle 108 can "carry away" the exclusive right of way 110, i.e. read it from the storage device 106 and e.g. delete it there (deletion can be achieved, for example, by overwriting the RFID tag in the storage device (e.g. RFID unit) 106 with an invalid code—in this case the storage device 106 can no longer provide an exclusive right of way 110, i.e. it is "deleted"). As there is only one exclusive right of way 110 for the line section 101 and the line section 101 can only be entered with the exclusive right of way 110, the line section 101 can only be used by this rail vehicle 108, and other rail vehicles cannot use the line section 101.

This scenario relates, for example, to the normal case. In particular situations (e.g. an emergency situation) the line section can be entered, e.g. subject to a written instruction from a signalman, with or without exclusive right of way.

If an invalid token is read, the RFID reader/writer is able to generate from the invalid token the valid token e.g. for storing in the second storage device at the end of the line section. This is e.g. possible for an initial situation in which the exclusive right of way is not yet present (either in the first or in the second storage device) and is provided e.g. via a (written) instruction from the signalman.

Figure 2:
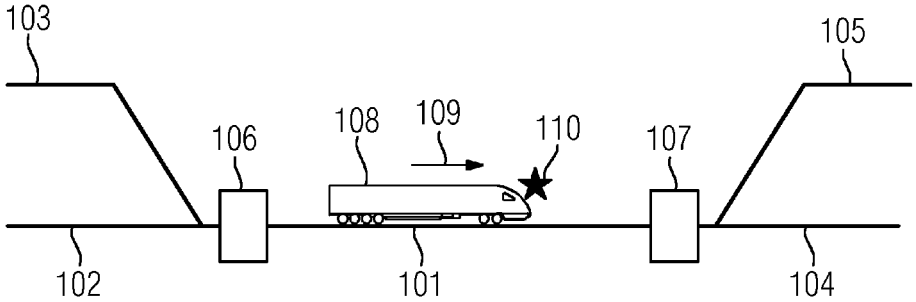
FIG. 2 shows a representation based on FIG. 1 wherein the rail vehicle enters the line section after successfully reading the exclusive right of way from the storage device.

FIG. 2 shows a representation based on FIG. 1 wherein the rail vehicle 108 enters the line section 101 after successfully reading the exclusive right of way 110 from the storage device 106. In this case it can also be seen that neither of the storage devices 106 or 107 has an exclusive right of way 110 in this situation and the line section 101 is therefore reserved for exclusive use by the rail vehicle 108.

Figure 3:
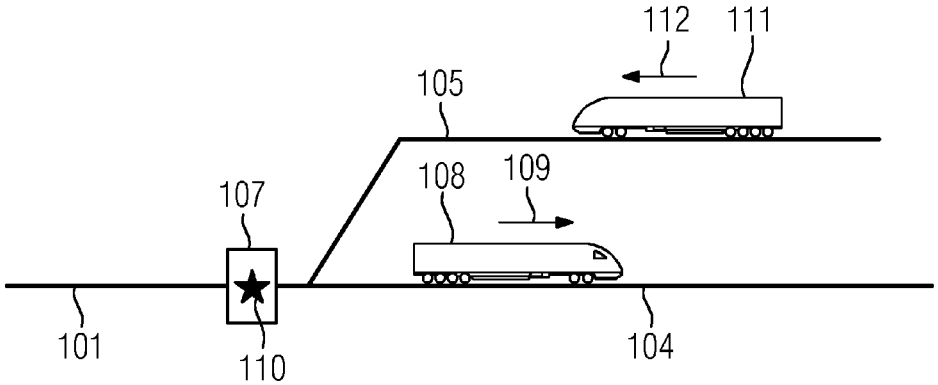
FIG. 3 shows a representation based on FIGS. 1 and 2 wherein the rail vehicle stores the exclusive right of way in the storage device on entering the station.

FIG. 3 shows a representation based on FIG. 1 and FIG. 2 wherein, as it enters the station (here on track 104 for example), the rail vehicle 108 stores the exclusive right of way 110 in the storage device 107 (e.g. an RFID tag of the storage device (RFID unit) 107 can be overwritten with a valid code for an exclusive right of way).

Figure 4:
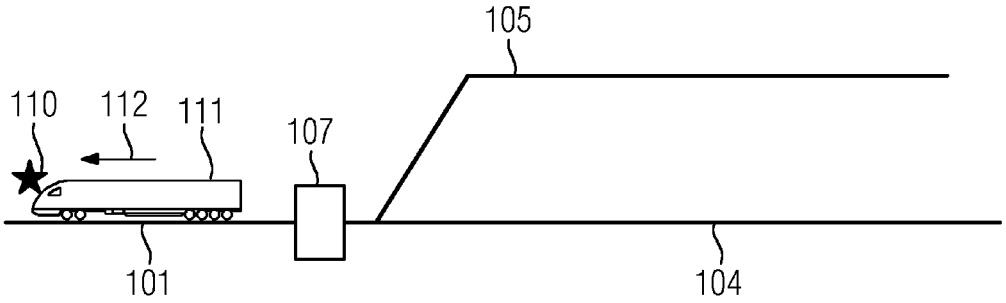
FIG. 4 shows a representation based on FIGS. 1 to 3 wherein a rail vehicle enters the line section in the opposite direction using for this purpose the exclusive right of way stored by the previous rail vehicle.

A rail vehicle 111 waiting in the opposite direction 112 on track 105 can now read the exclusive right of way 110 from the storage device 107 and carry it away (e.g. as explained previously, by the RFID tag of the storage device 107 being overwritten with an invalid code). FIG. 4 shows this case for the rail vehicle 111 running exclusively in the direction 112 on the line section 101 and which "carries" with it the exclusive right of way 110 and therefore no exclusive right of way can be provided in the storage device 107. "Carrying" by the rail vehicle is to be understood as meaning that the exclusive right of way 110 is transported by the rail vehicle 111 from the storage device 107 to the storage device 106 and no other rail vehicle can enter the line section 101 during said transportation.

It should be noted here that the exclusive right of way 110 can include different signals, data, information and/or values. In particular, the exclusive right of way can take a plurality of forms and in some cases be provided with additional information. The exclusive right of way can include a count, for example, which indicates the number of movements on the line section 101 (possibly also according to direction).

(2) In addition to the remarks under (1), the rail vehicle 108 or 111 can have a monitoring device which can control the rail vehicle on the basis e.g. also of a read-in invalid (or not present) exclusive right of way (if e.g. the invalid code is read from the RFID tag). In this case a braking operation of the rail vehicle can be initiated, in particular forced braking. Alternatively or in addition, a warning (e.g. an indication, an alarm, etc.) can be output or triggered.

For initialization and disruption situations, the monitoring device preferably has an operator control device enabling the driver (possibly on instructions from a signalman or an interlocking) to override the train control system.

(3) Another option is that it is possible for each RFID tag to be reset to an invalid value. Such resetting can be performed e.g. centrally by a signalman or an interlocking, or a signaling system, or decentrally by the driver (possibly as instructed by a signalman). This enables initialization to be carried out: if e.g. two trains are to run consecutively in the same travel direction, the initial situation of the RFID tags must be established in both stations (at both ends of the line section 101) prior to departure of the second train.

Initialization can take place, for example, such that both exclusive rights of way are set to "invalid" (e.g. the RFID tags are assigned an invalid code). With train protection according to (2), the driver of the first train to depart obtains permission to proceed from the traffic manager together with the instruction to override the train control system. On leaving the line section 101 the rail vehicle can then supply the storage device 106 or 107 with a valid exclusive right of way (e.g. the RFID tag is in this case assigned a valid code), so that, from then on, this storage device can provide the exclusive right of way for the line section 101.

(4) Another option consists in that the storage devices 106 and 107 installed on the line section indicate the states of the stored exclusive rights of way (e.g. "train movement possible" or "line section barred") or make them available to a display, or a light source. In particular, another component, e.g. a signal, can be provided which receives the state of the respective exclusive right of way from the storage device or reads it therefrom and displays the read-out state. Thus a driver of a rail vehicle can see even in the station whether he can obtain an exclusive right of way from the storage device and therefore enter the line section. In particular, the safety of a correct permission to proceed for the rail vehicle can be ensured in conjunction with the train stop function from (2).

Figure 5:
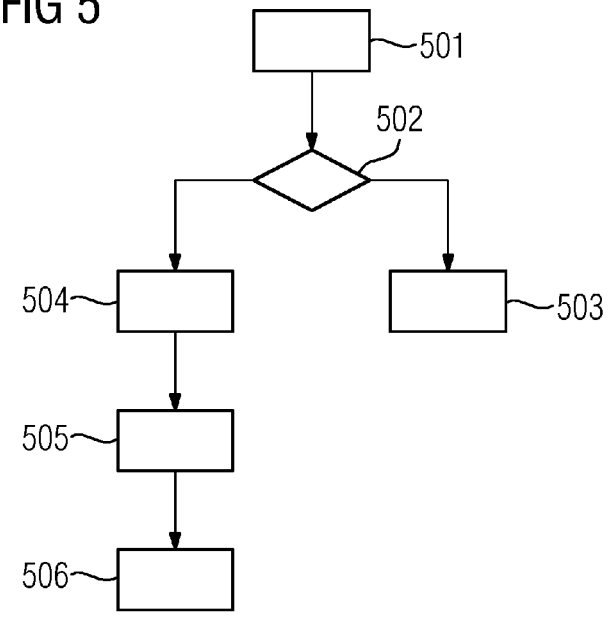
FIG. 5 shows a schematic flow chart for rail vehicle control e.g. in alternating directions over a single-track line section.

FIG. 5 shows a schematic flow chart for rail vehicle control e.g. in alternating directions over a single-track line section.

In a step 501 a rail vehicle intends to enter the line section. In a step 502 it is ascertained e.g. at the entrance to the line section or in advance by means of signaling whether an exclusive right of way on the line section can be provided by a storage device which is preferably disposed at one end of the line section. If no such exclusive right of way is available, the flow chart branches to step 503, running on the line section is not permissible; the rail vehicle may have to wait until exclusive right of way is available or—if it is already en route—a predefined action, e.g. a warning or an alarm is triggered and/or a braking operation is initiated.

On the other hand, if the exclusive right of way is available, the flow chart branches to step 504, the rail vehicle reads the exclusive right of way from the storage device and ensures that the exclusive right of way can no longer be made available by the storage device. In a step 505 the rail vehicle enters the line section. In a step 506, e.g. shortly before or shortly after leaving the line section, the rail vehicle returns the exclusive right of way to the storage device there, or ensures that said storage device can grant exclusive right of way as soon as the rail vehicle has left the line section. In steps 504 to 506 the exclusive right of way is therefore transported between the two storage devices which are provided to protect the line section. As stated, there are a plurality of possibilities for ensuring the functionality of "transportation" of this kind.

Figure 6:
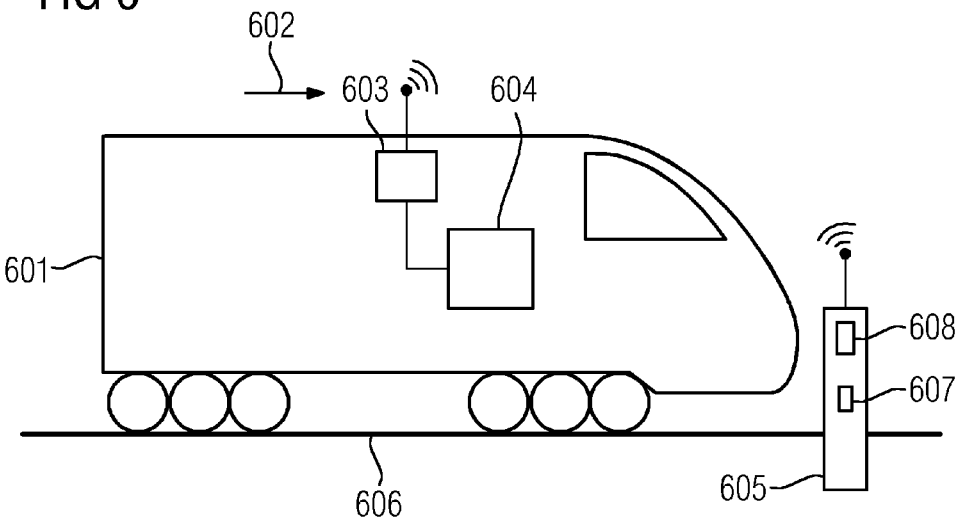
FIG. 6 schematically illustrates a scenario involving a rail vehicle which is moving or is to move in a direction of travel and ascertains, in communication with the storage device, whether or not it is allowed to enter the line section.

FIG. 6 schematically illustrates a scenario involving a rail vehicle 601 which is moving or is to move in a direction of travel 602. The rail vehicle 601 has a control unit 604, comprising e.g. a monitoring unit for monitoring the running of the rail vehicle 601, and a communication unit 603. The communication unit 603 can here communicate, for example, via a radio interface with a storage device 605 (e.g. by means of near field communication). The storage device 605 is disposed e.g. on, at or in the vicinity of a stretch of line 606. The storage device 605 has, for example, a memory 607 in which the exclusive right of way is stored e.g. for such time as it can be provided. The storage device 605 additionally has, for example, a communication unit 608 which can exchange data with the communication unit 603 of the rail vehicle 601.

It should be noted here that an antenna of the communication unit 603 can be mounted e.g. on the roof of the vehicle or underneath the rail vehicle 601. In particular, electrical and/or mechanical means, e.g. sensors, actuators, can be provided for communication purposes.

It should also be noted that only the communication devices of the storage device are disposed on or in the vicinity of the stretch of line; the rest of the storage device can be located elsewhere. A communication device of this kind is advantageously disposed so as to be contactable by the rail vehicle. There are a plurality of electrical and/or mechanical possibilities for implementing contactability of this kind. In particular, the storage device can also be of distributed design in this respect.

It is advantageous here that, for simplified traffic management, the exclusive right of way can be transferred decentrally by electronic means, e.g. via RFID tags, between rail vehicles plying alternately on a single-track line section. This thus managed exclusive right of way can also be used for controlling the rail vehicle (e.g. initiating or carrying out a braking operation).

Another advantage is that this solution requires neither interlocking equipment, track clear indications in the traditional sense, data radio, nor signals. Inexpensive, automatic simplified traffic management can therefore be achieved for alternating traffic on single-track line sections.

For example, for transferring the exclusive rights of way, storage devices having RFID tags can be provided after the last switch after departure from the station.

Decentralized control by means of an exclusive right of way (token) is proposed for rail vehicles running in alternate directions on a single-track line section, e.g. between two stations. For this purpose a storage device, e.g. as an RFID unit, is preferably disposed at either end of the line section, wherein only one exclusive right of way for the vacant line section exists which is kept either in one of the two storage units or is carried by a rail vehicle running on the line section. In the latter case, the line section is therefore effectively protected from being entered by another rail vehicle, because neither of the storage units can provide the exclusive right of way which is being transported by the rail vehicle between the storage units or more precisely is in the possession of the rail vehicle. It is advantageous here that the solution presented creates an efficient possibility of decentralized train protection and can therefore be implemented much more cost effectively than existing central train protection or simplified traffic management approaches.

Although the invention has been illustrated and described in detail by at least one exemplary embodiment shown, the invention is not limited thereto and other variations can be deduced therefrom by the person skilled in the art without departing from the scope of protection sought for the invention.

REFERENCE CHARACTER LIST

101 line section (single-track)
102 track (of a station)
103 track (of a station)
104 track (of a station)
105 track (of a station)
106 storage device
107 storage device
108 rail vehicle
109 direction of travel
110 exclusive right of way
111 rail vehicle
112 direction of travel (counter to direction of travel 109)
501-506 steps of a method for controlling a rail vehicle by means of an exclusive right of way
601 rail vehicle
602 direction of travel
603 communication unit
604 control unit
605 storage device
606 line section
607 memory
608 communication unit

The invention claimed is:

1. A method for controlling rail vehicles, the method comprising:

providing a first storage device adjacent one end of a line section and a second storage device adjacent an opposite end of the line section;

storing an exclusive right of way on the line section into the first storage device and ensuring that the exclusive right of way on the line section is not stored on the second storage device;

reading the exclusive right of way on the line section from the first storage device by a rail vehicle and placing the first storage device in a state in which the first storage device can provide no exclusive right of way on the line section; and wherein the rail vehicle stores the exclusive right of way into the second storage device shortly before leaving the line section, shortly after leaving the line section or upon leaving the line section.

2. The method according to claim 1, wherein the line section is a single-track line section.

3. The method according to claim 2, wherein the storage devices are disposed at the ends of the single-track line section.

4. The method according to claim 1, wherein the first storage device and the second storage device have an RFID tag, and the exclusive right of way corresponds to at least one predefined value or signal of the RFID tag.

5. The method according to claim 1, which comprises, for entering and driving on the line section, reading the exclusive right of way is read from the first storage device and storing the exclusive right of way by the rail vehicle.

6. The method according to claim 5, which comprises, when the exclusive right of way has been read out, marking the exclusive right of way as invalid, overwritten, reset or deleted in the first storage device.

7. The method according to claim 1, wherein the rail vehicle has a communication device for reading from and writing to the first and the second storage device.

8. The method according to claim 1, which comprises braking the rail vehicle on entering the line section if the rail vehicle has not obtained the exclusive right of way.

9. The method according to claim 1, wherein the exclusive right of way comprises a signal, a token, a value, or an item of information.

10. The method according to claim 1, which comprises executing and processing the exclusive right of way and/or operations involving the exclusive right of way with data protection.

11. The method according to claim 1, which comprises displaying a state of the first storage unit and/or of the second storage unit relating to an availability of the exclusive right of way.

12. A rail vehicle, comprising:

a communication device for communicating with a first storage device adjacent one end of a line section and a second storage device adjacent an opposite end of the line section;

said communication device being configured to read an exclusive right of way on a line section from the first storage device, and wherein the first storage device can be placed in a state in which the first storage device cannot provide an exclusive right of way on the line section; and said communication device being configured to pass the exclusive right of way to the second storage device, to thereby place the second storage device in a state in which the second storage device is enabled to provide the exclusive right of way on the line section.

13. The rail vehicle according to claim 12, comprising a monitoring device configured to carry out a predetermined action if the rail vehicle enters the line section without having obtained an exclusive right of way.

14. The rail vehicle according to claim 13, wherein the monitoring device is configured to issue a warning and/or initiate a braking operation.

* * * * *